US007755464B2

(12) United States Patent
Hisamitsu

(10) Patent No.: US 7,755,464 B2
(45) Date of Patent: Jul. 13, 2010

(54) INDUCTOR DEVICE

(75) Inventor: Kazuya Hisamitsu, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 12/336,625

(22) Filed: Dec. 17, 2008

(65) Prior Publication Data

US 2009/0261935 A1 Oct. 22, 2009

(30) Foreign Application Priority Data

Apr. 17, 2008 (JP) ..... 2008-108101

(51) Int. Cl.
*H01F 5/00* (2006.01)

(52) U.S. Cl. ..... 336/200; 336/232; 336/223

(58) Field of Classification Search ..... None
See application file for complete search history.

(56) References Cited

U.S. PATENT DOCUMENTS 5,543,773 A * 8/1996 Evans et al. ..... 336/183
6,927,664 B2 * 8/2005 Nakatani et al. ..... 336/200
2006/0038621 A1 2/2006 Shiramizu et al.
2008/0074228 A1 * 3/2008 Erickson et al. ..... 336/200

FOREIGN PATENT DOCUMENTS

JP 2006-60029 3/2006

* cited by examiner

*Primary Examiner*—Anh T Mai
(74) *Attorney, Agent, or Firm*—Katten Muchin Rosenman LLP

(57) ABSTRACT

An inductor device is provided. The inductor includes: a first inductor; a second inductor, wherein the first inductor and the second inductor are arranged such that a magnetic field generated by the first inductor and passing through the inside of a loop formed from the second inductor comprises a first magnetic field and a second magnetic field, the first magnetic field passing from the topside of the loop to the downside of the loop, the second magnetic field passing from the downside of the loop to the topside of the loop.

10 Claims, 9 Drawing Sheets

INDUCTOR DEVICE

CROSS-REFERENCE TO RELATED APPLICATIONS

This application is based upon and claims the benefit of priority of the prior Japanese Patent Application No. 2008-108101, filed on Apr. 17, 2008, the entire contents of which are incorporated herein by reference.

FIELD

The embodiment discussed herein is directed to an inductor device.

BACKGROUND

An inductor is generally used for an oscillating circuit, filter circuit, transformer, matching circuit. Further, according to advanced technology for integration of a semiconductor, the inductor is used for RFIC (Radio Frequency-Integrated Circuit), which is a single semiconductor device having modulation/demodulation circuit for processing high frequency signals, and the inductor is used as a choke coil for power supply IC. Therefore, multiple inductors will be arranged on one electronic circuit.

In that case, since it is preferable to avoid generating magnetic coupling of multiple inductors, the multiple inductors are arranged at a wide interval. Therefore, a large installation space on an electronic circuit for arranging the inductor on an electronic circuit is required.

In order to avoid degradation of circuit characteristic, it is known that a semiconductor integrated circuit utilizes two spiral inductors for differential signals and thereby reduce a leakage of magnetic flux into the outside of the spiral inductors. In the semiconductor integrated circuit, a first spiral inductor turns in the opposite direction to a second spiral inductor. Therefore, if the differential signals flow in the first spiral inductor and the second spiral inductor, for example, if an upward magnetic field in the center section of the first inductor is generated, a downward magnetic field in the center section of the second inductor is generated. In this way, since the generated magnetic fields are directed such that both magnetic fields are enhanced, reactance and Q value of spiral inductors are improved. It is known that Japanese Laid-open Patent Application Publication No. 2006-60029 discusses related technology.

However, in the above mentioned conventional technology, if magnetic field generated by one of the spiral inductors passes through center of the loop of the other of the spiral inductors, the direction of a differential signal flowing in the one of the spiral inductor is limited to improve the Q value, and it is impossible to reduce an influence in other spiral inductor generated by one of the spiral inductors.

SUMMARY

According to an aspect of the invention, an inductor device includes a first inductor; and a second inductor, wherein the first inductor and the second inductor are arranged such that a magnetic field generated by the first inductor and passing through the inside of the loop formed from the second inductor comprises a first magnetic field and a second magnetic field, the first magnetic field passing from topside of the loop to the downside of the loop, the second magnetic field passing from the downside of the loop to the topside of the loop.

Additional objects and advantageous of the embodiment will be set forth in part in the description which follows, and in part will be obvious from the description, or may be learned by practice of the invention. The object and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF DRAWINGS

In the following embodiment will be described with reference to the accompanied drawings, in which.

DESCRIPTION OF EMBODIMENT(S)

This embodiment indicates multiple inductors wherein a magnetic field generated by one inductor and passing through inside of the loop formed from the other inductor includes a magnetic field passing from the topside of the loop to downside of the loop, and a magnetic field passing from the downside of the loop to the topside of the loop.

Figure 1:
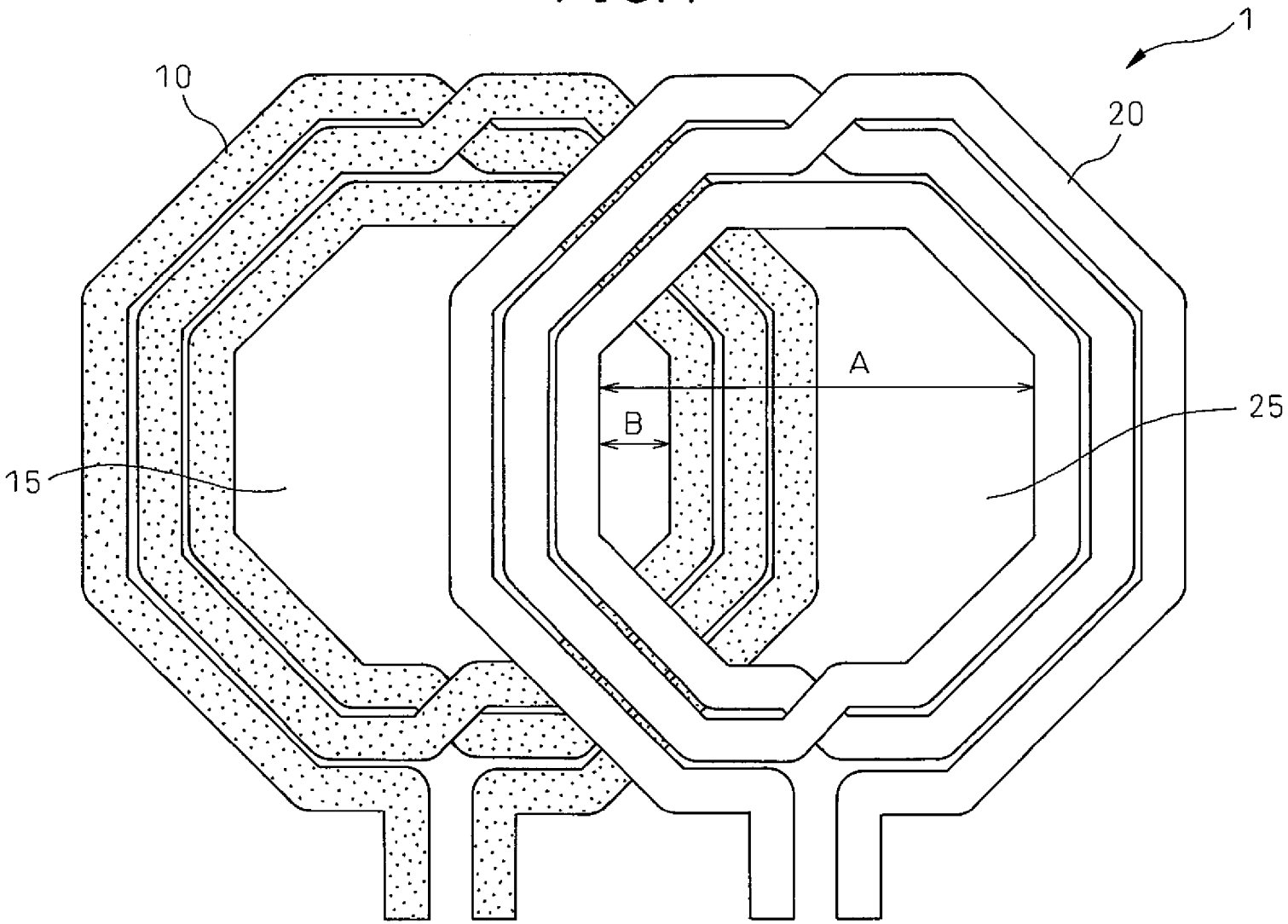
FIG. 1 illustrates multiple inductors in accordance with a first embodiment.

FIG. 1 illustrates multiple inductors in accordance with a first embodiment. Inductor 1 includes inductor 10 and inductor 20. As illustrated in FIG. 1, seen from the viewpoint vertical to the loop, inductors 10, 20 are arranged such that inside portion 15 of the loop formed from inductor 10 overlaps with the inside portion 25 of the loop formed from inductor 20. The loop formed from inductor 10 and the loop formed from inductor 20 are apart from each other in a vertical direction.

Figure 2:
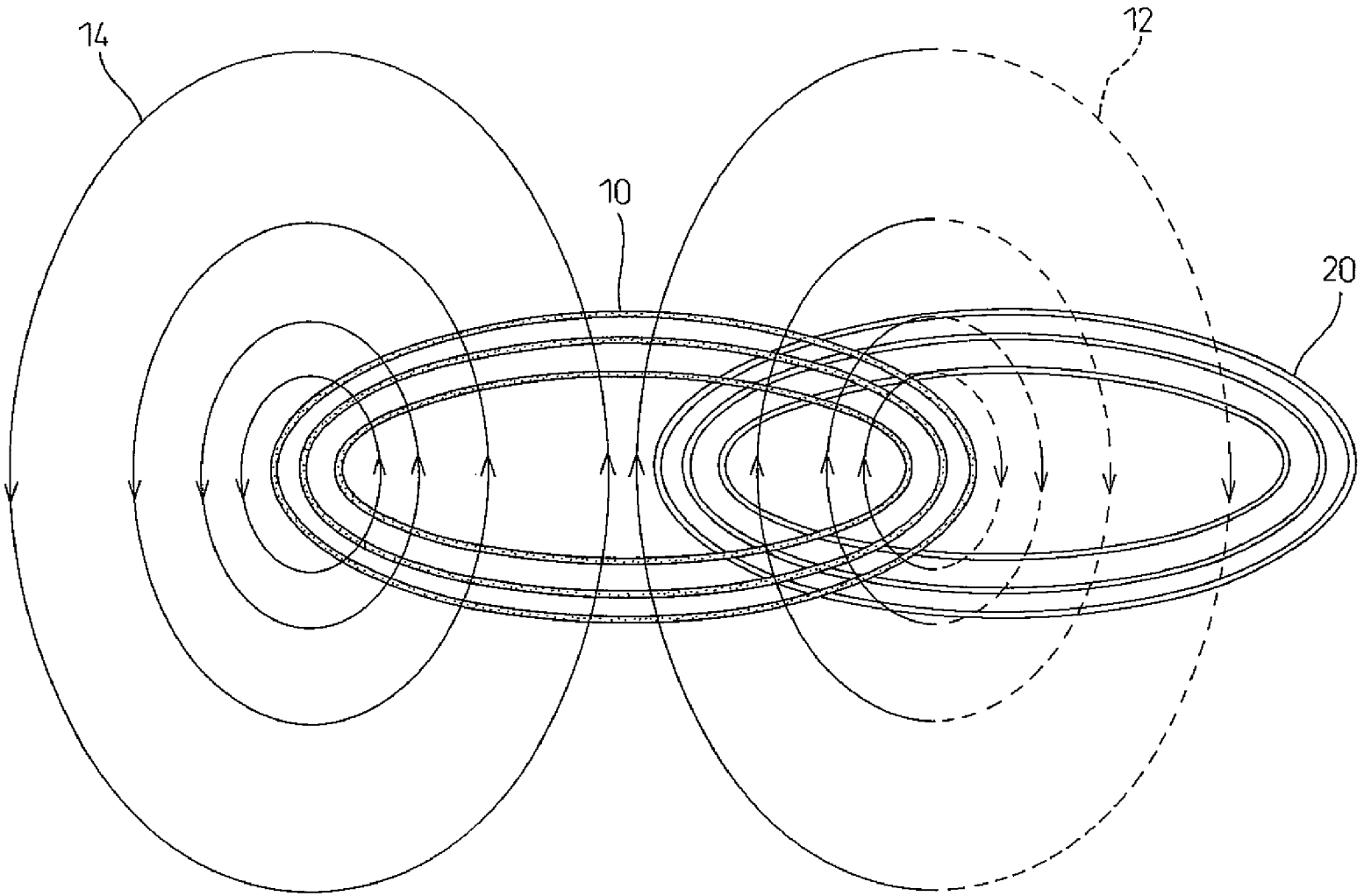
FIG. 2 illustrates magnetic field generated by inductor 10.

FIG. 2 illustrates magnetic field generated by inductor 10. The direction of the magnetic field is perpendicular to the loop surface, and the magnetic field passes through the center of the loop. In the embodiment, inductor 10 generates a magnetic field from the downside of the loop to the upside of the loop, magnetic field 12, which rotates clockwise on a vertical surface, on the right outside of the loop, and magnetic field 14, which rotates anticlockwise on a vertical surface, on the left outside of the loop. The magnetic field 12 includes two magnetic fields. One is a magnetic field passing through the internal section 25 of the loop of inductor 10 from the topside to the downside. The magnetic field is illustrated on the left side from the center of magnetic field 12. The other is a magnetic field passing through the internal section 25 of the loop of inductor 10 from the downside to the topside. The magnetic field is illustrated on the right side from the center of magnetic field 12.

Figure 3B:
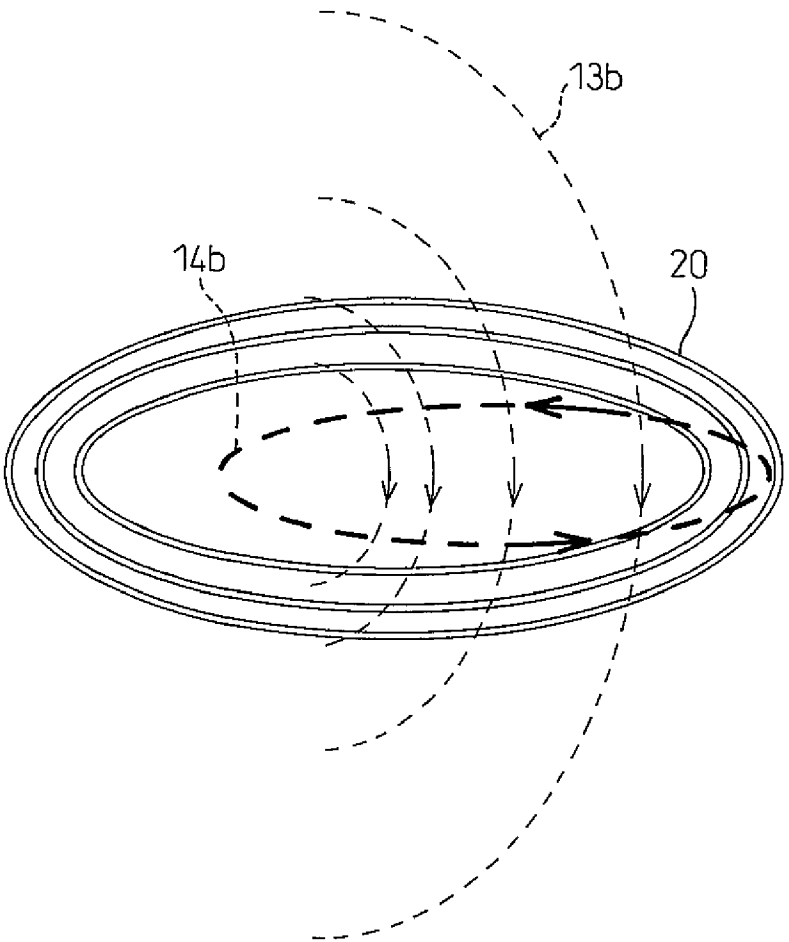
FIGS. 3A and 3B illustrate magnetic field in inductor 20 generated by inductor 10.
Figure 3A:
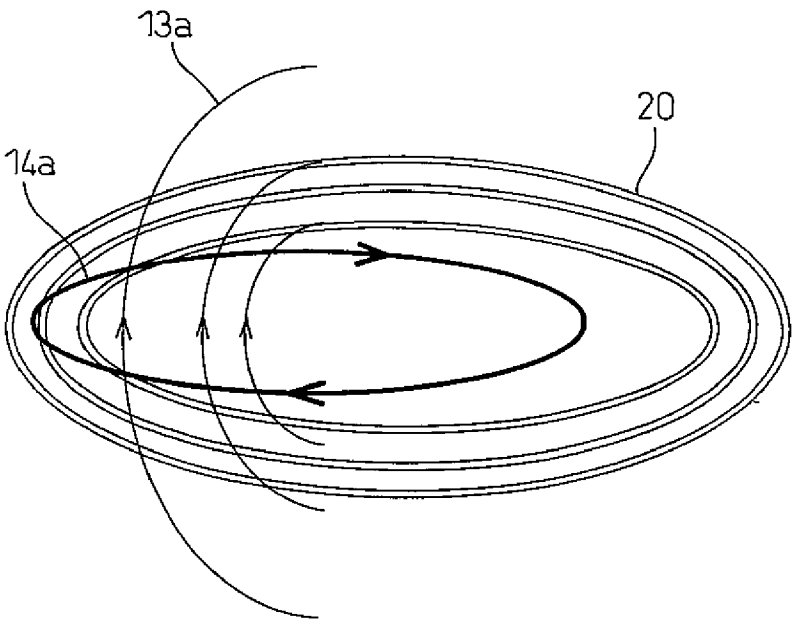

FIGS. 3A and 3B illustrate a magnetic field in inductor 20 generated by inductor 10. The magnetic field 12 includes two magnetic fields. One is an upward magnetic field 13*a* passing through the inside of inductor 20. The upward magnetic field 13*a* is illustrated on the left side from the center of magnetic field 12. The other is a downward magnetic field 13*b* passing through the inside of inductor 20. The downward magnetic field 13*b* is on the right side from the center of magnetic field 12. The upward magnetic field 13*a* and downward magnetic field 13*b* are generated to cancel magnetic flux thereon. If the upward magnetic field 13*a* is generated, induced current 14*a* which flows on a winding wire in a clockwise direction is generated in accordance with Len'z Law. On the other hand, if downward magnetic field 13*b* is generated, induced current 14*b* which flows on winding wire in an anticlockwise direction is generated in accordance with Len'z Law.

In this connection, since induced current 14*a,* 14*b* generated by upward magnetic field 13*a* and downward magnetic field 13*b* flow in opposite directions to each other such that induced current 14*a,* 14*b* generate to negate magnetic flux thereon, inductor 20 can reduce the effect of mutual induction by inductor 10. Thus, it is possible to reduce an influence in other spiral inductor generated by one of the spiral inductor. The more the ampere values of induced current get close to each other, the less the effect of mutual induction reduces. Therefore, by stacking the center of inductor 10 on the center of inductor 20 to conform amplitude of upward magnetic field 13*a* to amplitude of downward magnetic field 13*b,* the effect of mutual induction generating on inductor 20 can be reduced as much as possible.

Figure 4:
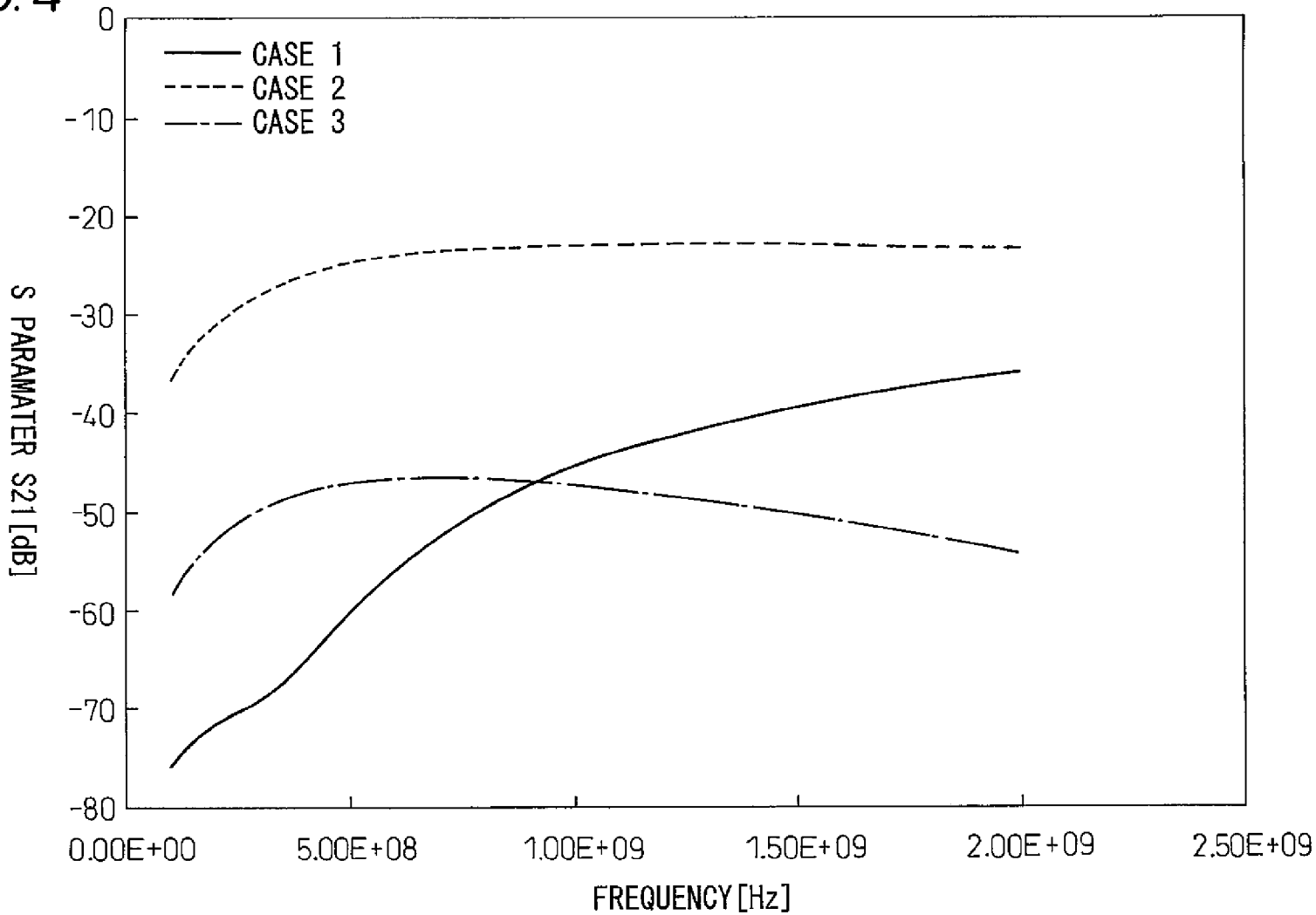
FIG. 4 illustrates relationship between frequency of alternation current flowing in inductor device and S parameter.

FIG. 4 illustrates relationship between frequency of alternation current flowing in inductor device and S parameter S21. In any cases illustrated in FIG. 4, two spiral inductors can be used, in which number of turns is 3 and external diameter is 200 um. In case 1 which is indicated by a continuous line, one spiral inductor is placed on the other spiral inductor with 50 um length horizontally spaced. In case 2 which is indicated by dashed line, one spiral inductor is placed on the other spiral inductor with 10 um length horizontally spaced. In case 3 which is indicated by chain dash line, one spiral inductor is placed on the other spiral inductor with 200 um length horizontally spaced. If the area occupied by the two spiral inductors of case 2 is defined as base value of 1, the area occupied by those of case 1 and the area occupied by those of case 3 are 0.8 and 1.5, respectively.

As illustrated in FIG. 4, the value of S parameter 21 of case 1 is lower that that of case 2. Thus, induced current in one spiral inductor by magnetic field generated by alternating current that flow in the other spiral inductor can be reduced. The frequency illustrated in FIG. 4 includes frequency band used by second generation and third generation mobile phones. The S parameter value can be also reduced in the 0.8 MHz frequency band for second generation and the 2.0 MHz frequency band for third generation. Further, although the value of S parameter 21 of case 3 is also lower that that of case 2, the area occupied by spiral inductors of case 1 can be half of that of case 3.

Further, simulation results indicates that if the length B in area occupied by two spiral inductors is set such that the value of B/A is from 0 to 0.5 in the inductor device illustrated in FIG. 1, S parameter of case 1 can be lower than that of case 2.

Thus, inductor device 1 can minimize the occupied area thereof in semiconductor IC on which inductor device 1 is placed. Further, inductor device 1 can receive any type of input signals and can be arranged in any type of configuration, as long as the magnetic field that generated by one spiral inductor in inductor device 1 and that passes through the internal area of the other spiral inductor in inductor device 1 are generated in a direction opposite to a direction of a magnetic field generated by the other spiral inductor. The closed loop configuration is not required to prevent magnetic flux from leaking to the surroundings of inductor device 1. Inductor device 1 can keep Q value highly and can prevent inductance of the inductor device 1 decreasing.

Figure 5:
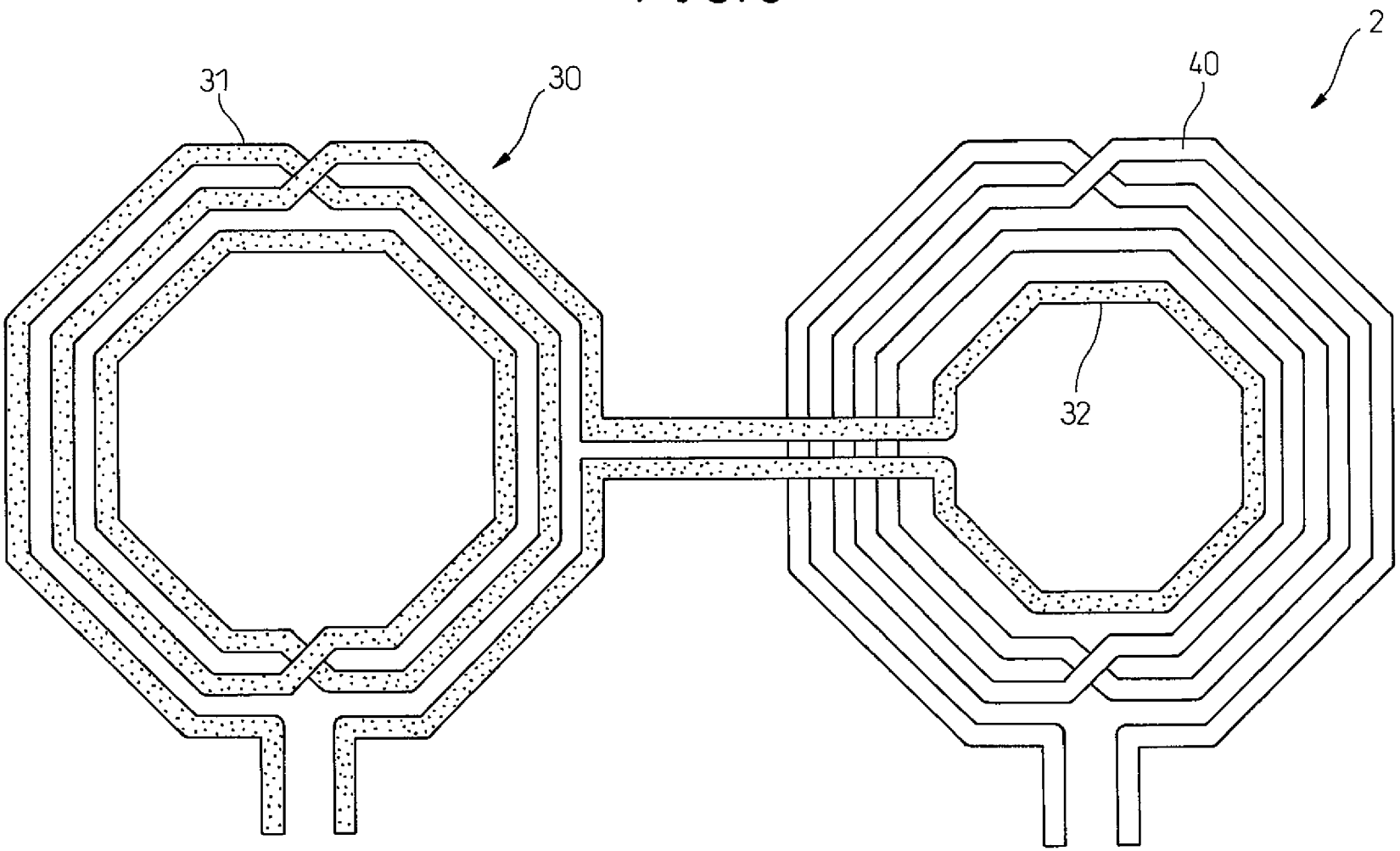
FIG. 5 illustrates multiple inductors in accordance with a second embodiment.

FIG. 5 illustrates inductor device 2 according to the second embodiment. Inductor device 2 includes inductor 30 and inductor 40. As illustrated in FIG. 5, loop 32 is arranged in the center of inductor 40, such that the magnetic field generated by loop 32 negates the magnetic field generated by inductor 30. Loop 32 is placed on loop 40 which are vertically spaced from each other, in order to keep an insulated condition.

Figure 6:
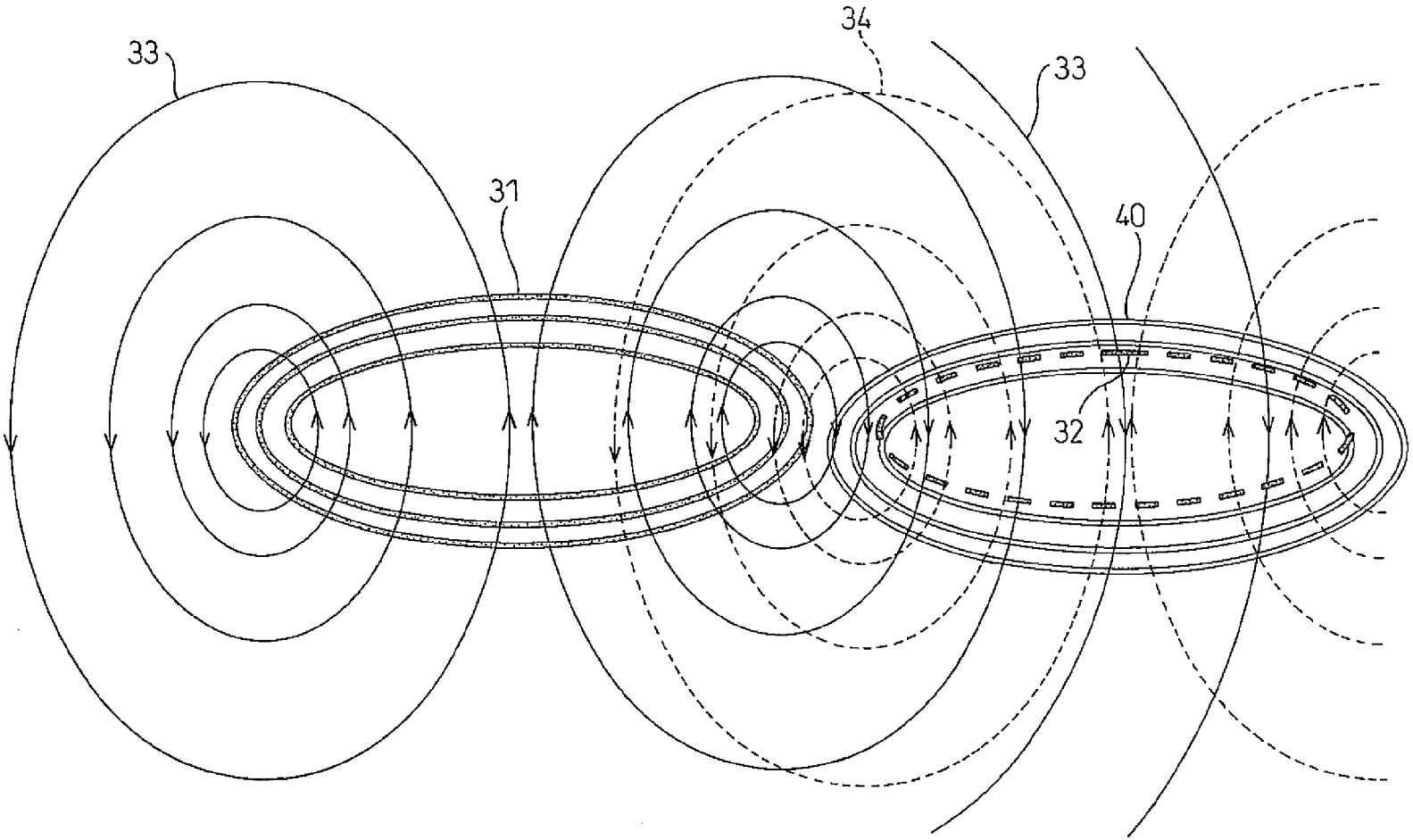
FIG. 6 illustrates magnetic field generated by inductor 30.

FIG. 6 illustrates the magnetic field generated by inductor 30. Loop 31 of inductor 30 generates magnetic field 33, and loop 32 of inductor 30 generates magnetic field 34. In this case, the direction of magnetic field 33 is opposite to that of magnetic field 34, and magnetic field 33 that passes through the center portion of inductor 40 and magnetic field 34 generates such that magnetic fields 33, 34 negate themselves.

Figure 7B:
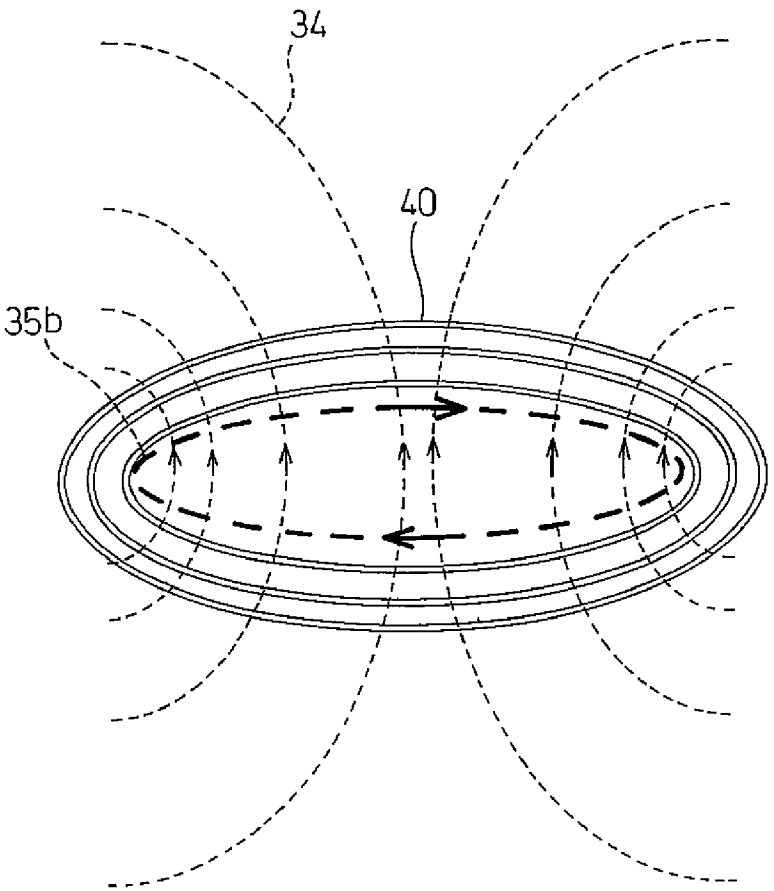
FIGS. 7A and 7B illustrate magnetic field in inductor 40 generated by inductor 30.
Figure 7A:
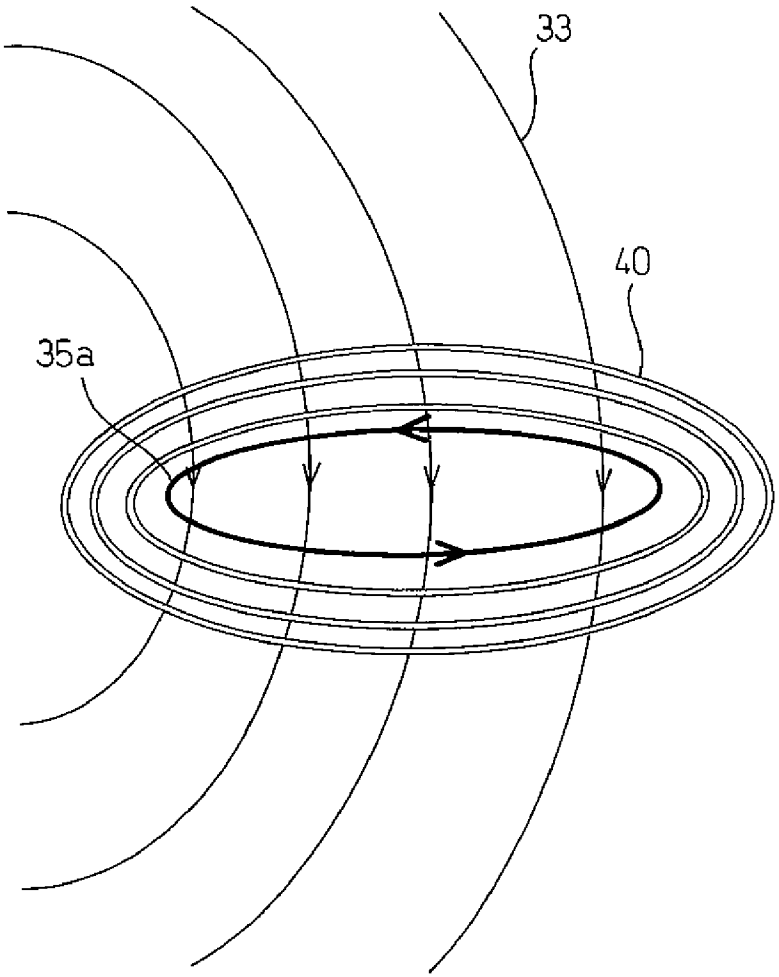

FIGS. 7A and 7B illustrates the magnetic field in inductor 40 generated by inductor 30. The direction of magnetic field 33 is downward, and thereby, induced current 35*a* that flows counterclockwise on loop 31 is generated based on Lenz's law. On the other hand, the direction of magnetic field 34 is upward, and thereby, induced current 35*b* that flows clockwise on a coil of spiral inductor 40 is generated based on Lenz's law.

As described above, the direction of induced current 35*a* generated by magnetic field 33 that passes thorough the center section of spiral inductor 40 is opposite to the direction of induced current 35*b* generated by magnetic field 34 that passes thorough the center section of spiral inductor 40, such that magnetic field 33 and magnetic field 34 negate one another. Therefore, spiral inductor 40 can reduce the effect of mutual induction by spiral inductor 30. The closer the ampere value of induced current of 35*a,* 35*b* get to each other, the less the effect of mutual induction reduces. Therefore, loop 31 and loop 32 are arranged to conform to the amplitude of upward magnetic field 33 to that of downward magnetic field 34, and thereby, the effect of mutual induction between spiral inductor 30 and spiral inductor 40 can be minimized.

As described above, since spiral inductors in inductor device 2 are not arranged independently, the space occupied by inductor device 2 can be reduced. As long as the direction of magnetic field generated in the center of one spiral inductor is opposite to that of the magnetic field generated by the other spiral inductor, inductor device 2 can receive any type of input signal. Further, the closed loop is not required to prevent leaking magnetic flux around inductor device 2, and thereby, inductor device 2 can keep Q value highly and can prevent inductance of the inductor device 2 decreasing.

Figure 8:
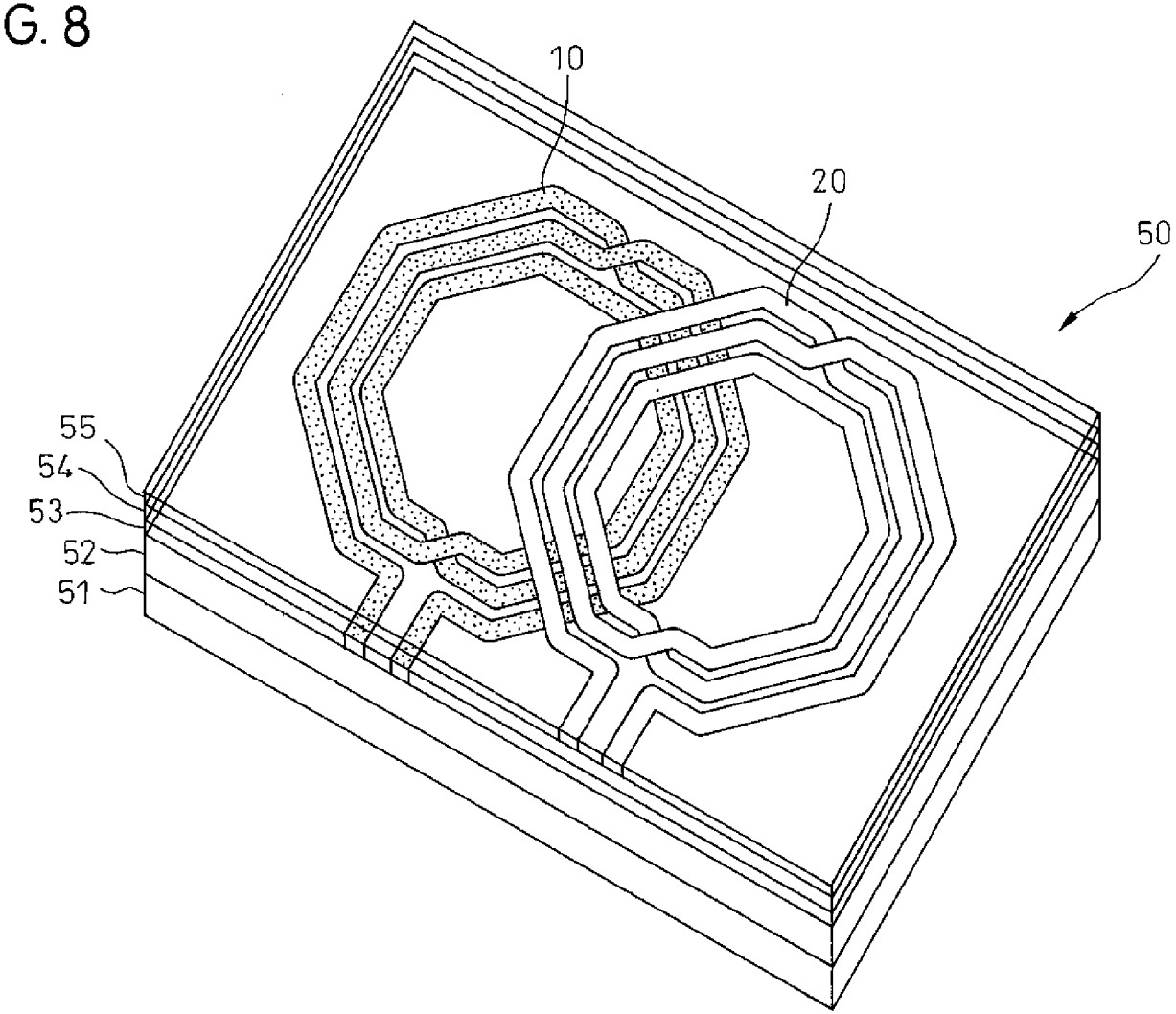
FIG. 8 is a perspective diagram that illustrates a semiconductor integrated circuit including the inductor device.
Figure 9:
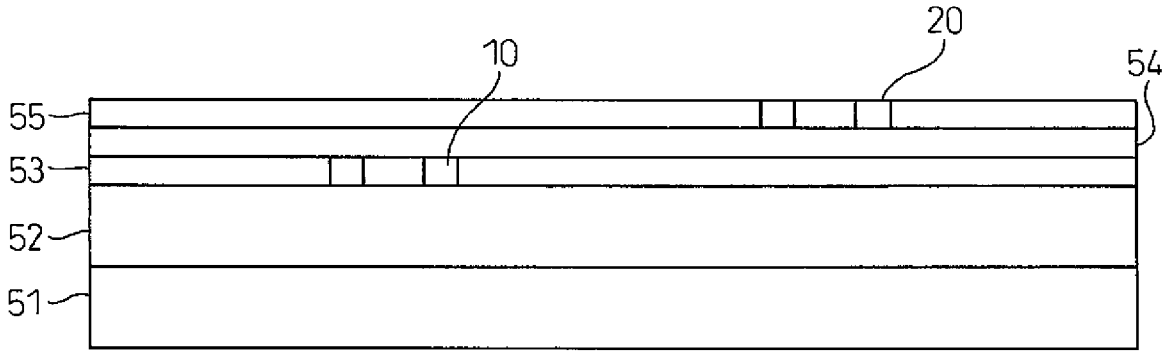
FIG. 9 is a cross-section diagram that illustrates a semiconductor integrated circuit including the inductor device.

FIGS. 8 and 9 illustrate the example of semiconductor integrated circuit which includes an inductor device. FIG. 8 is perspective view of semiconductor integrated circuit 50, FIG. 9 is sectional view of semiconductor integrated circuit 50. As illustrated, insulated layer 52 is formed on substrate 51, and spiral inductor 10 surrounded by insulated layer 54 is disposed on layer 52. Insulated layer 54 is formed on spiral inductor 10, and spiral inductor 20 surrounded by insulated layer 55 is disposed on insulated layer 54. Transistor, diode, other elements such as resistor, and lead line thereof are disposed on substrate 51, although the elements are not illustrated in FIGS. 8 and 9.

Although inductor 10 and inductor 20 are disposed on a layer as illustrated in FIGS. 8 and 9, inductor 30 and inductor

40 can be disposed on insulated layer 53 and insulated layer 55, respectively, or vice versa. As described above, insulated layer 53 is inserted into between layers which include spiral inductor, and thereby, favorable insulated condition for preventing decrease of circuit characteristic is accomplished.

All examples and condition language recited herein are intended for pedagogical purpose to aid the reader in understanding the principles of the invention and the concepts contributed by the inventor to furthering the art, and are to be construed as being without limitation to such specifically recited examples and condition, nor does the organization of such examples in the specification relate to a showing of the superiority and inferiority of the invention. Although the embodiment(s) of the present invention(s) has been described in detail, it should be understood that the various changes, substitutions, and alterations could be made hereto without departing from the spirit and scope of the invention.

What is claimed is:

1. An inductor device comprising:

a first inductor; and, a second inductor, wherein the first inductor and the second inductor are arranged such that a magnetic field generated by the first inductor and passing through inside of a loop formed from the second inductor comprises a first magnetic field and a second magnetic field, the first magnetic field passing from the topside of the loop to the downside of the loop, the second magnetic field passing from the downside of the loop to the topside of the loop.

2. The inductor device of claim 1, wherein the first magnetic field and the second magnetic field are formed from a circular magnetic field formed around loop of the first inductor.

3. The inductor device of claim 1, wherein:

one of the first magnetic field and the second magnetic field is formed by a magnetic field formed around a first loop formed from the first inductor; and the other of the first magnetic field and the second magnetic field is formed by magnetic field formed around a second loop formed from the first inductor.

4. The inductor device of claim 1, wherein the first inductor and the second inductor are arranged such that an inside of loop formed from the first inductor overlaps with an inside of loop formed from the second inductor.

5. The inductor device of claim 1, wherein a part of the loop formed from the first inductor is arranged inside of loop formed from the second inductor.

6. A semiconductor integrated circuit comprising:

an insulator layer;

a first inductor being laid on the insulator layer; and, a second inductor being laid on the insulator layer, wherein the first inductor and the second inductor are arranged such that a magnetic field generated by the first inductor and passing through inside of the loop formed from the second inductor comprises a first magnetic field and a second magnetic field, the first magnetic field passing from the topside of the loop to the downside of the loop, the second magnetic field passing from the downside of the loop to the topside of the loop.

7. The semiconductor of claim 6, wherein the first magnetic field and the second magnetic field are formed from a circular magnetic field formed around loop of the first inductor.

8. The semiconductor of claim 6, wherein:

one of the first magnetic field and the second magnetic field is formed by a magnetic field formed around a first loop formed from the first inductor; and the other of the first magnetic field and the second magnetic field is formed by a magnetic field formed around a second loop formed from the first inductor.

9. The semiconductor of claim 6, wherein the first inductor and the second inductor are arranged such that an inside of the loop formed from the first inductor overlaps with an inside of the loop formed from the second inductor.

10. The semiconductor of claim 6, wherein a part of a loop formed from the first inductor is arranged inside of a loop formed from the second inductor.

* * * * *